US005190466A

United States Patent [19]

McVey

[11] Patent Number: 5,190,466

[45] Date of Patent: Mar. 2, 1993

[54] LOCKING CONNECTOR FOR DETACHABLE POWER CORDS

[76] Inventor: Jack L. McVey, P.O. Box 48726, Wichita, Kans. 67201-8726

[21] Appl. No.: 727,461

[22] Filed: Jul. 9, 1991

[51] Int. Cl.[5] ..... H01R 13/62

[52] U.S. Cl. ..... 439/304; 439/133; 70/58

[58] Field of Search ..... 439/304, 347, 133, 134, 439/352, 372; 70/57, 58

[56] References Cited

U.S. PATENT DOCUMENTS

| | | | |
|---|---|---|---|
| 2,654,073 | 9/1953 | Katz | 339/37 |
| 3,345,603 | 10/1967 | Cohen | 339/176 |
| 4,025,140 | 5/1977 | Matys | 339/37 |
| 4,167,658 | 9/1979 | Sherman | 200/44 |
| 4,482,789 | 11/1984 | McVey | 200/44 |
| 4,566,297 | 1/1986 | Hawley | 339/91 B |
| 4,812,131 | 3/1989 | Sieverman | 439/134 |
| 4,957,446 | 9/1990 | Belsky | 439/134 |

*Primary Examiner*—Gary F. Paumen
*Assistant Examiner*—Hien D. Vu

[57] ABSTRACT

An electrical connector (10) for a detachable power cord (18) that can be selectively locked in place when engaged in a standard appliance power socket (80) of an electrically powered applicance or device that utilizes a detachable power cord, such as a personal computer or a desk-top laser printer, for instance. A securing means (64, 88, 106) is provided to prevent removal of the connector from the appliance power socket, which in turn prevents circumvention of any access-control means that may be operatively associated with the power cord. A controlled-access operating means (30) is provided whereby an authorized user can lock the connector into or unlock the connector from the appliance power socket.

6 Claims, 4 Drawing Sheets

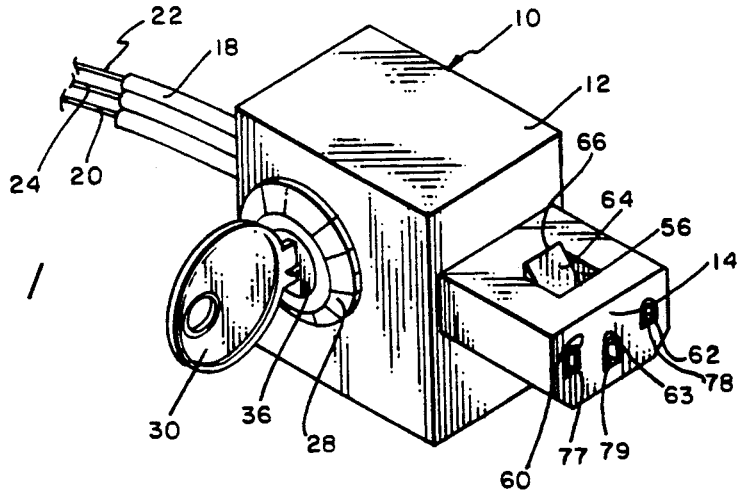
FIG. 1
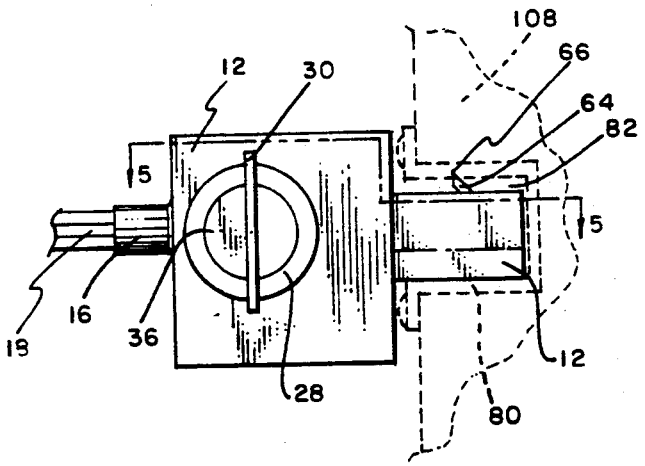
FIG. 2
FIG. 3
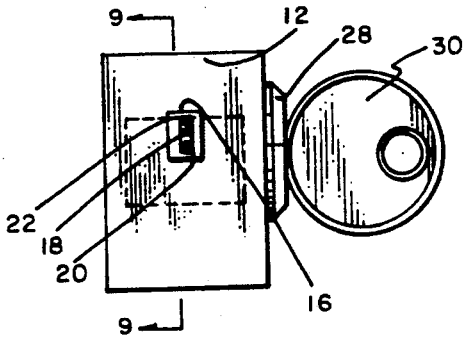
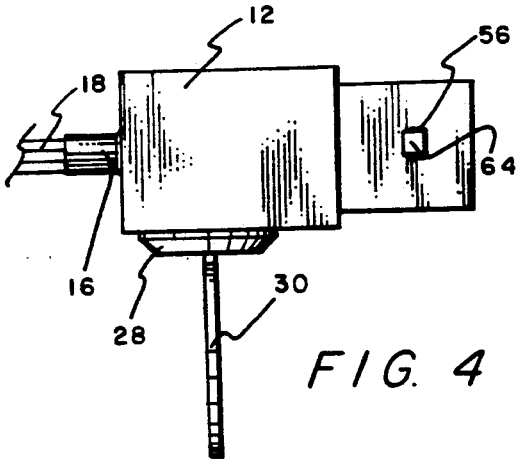
FIG. 4

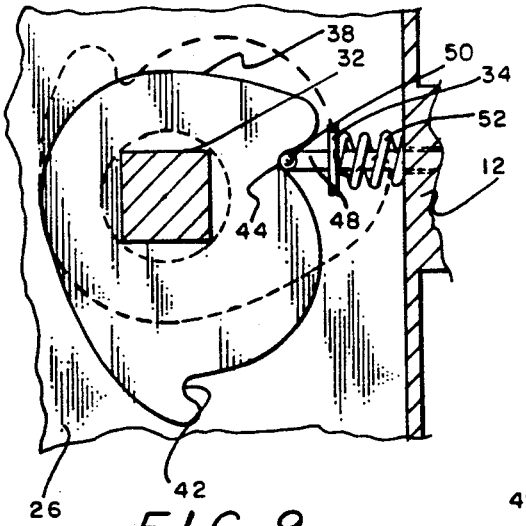
FIG. 9
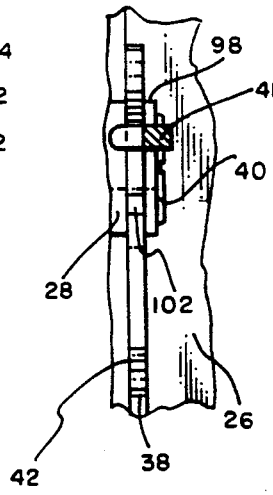
FIG. 10
FIG. 11
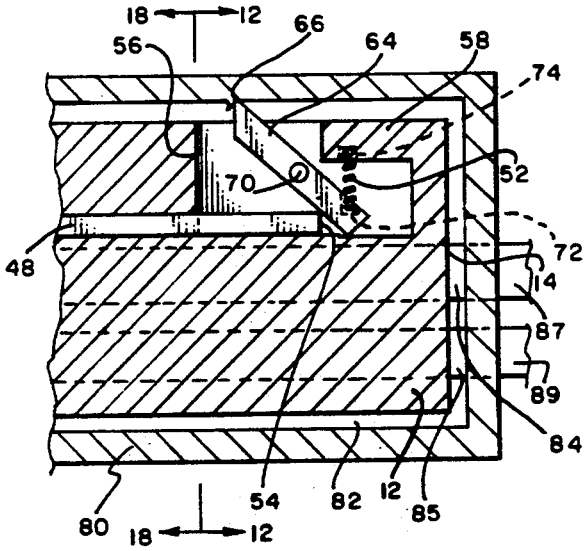
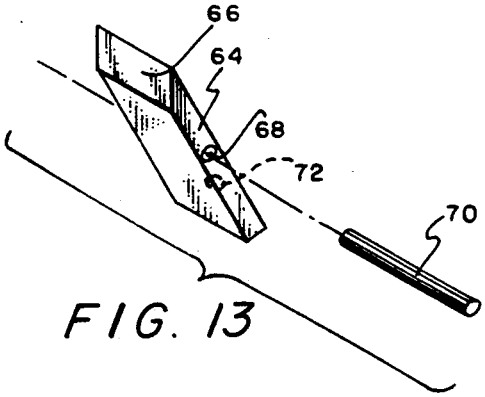
FIG. 13
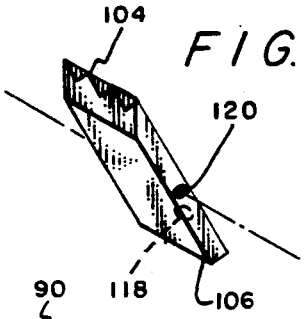
FIG. 14
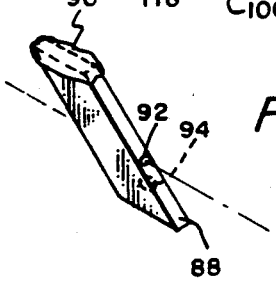
FIG. 15
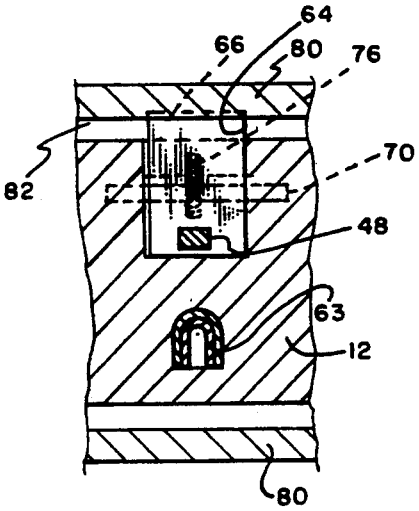
FIG. 12

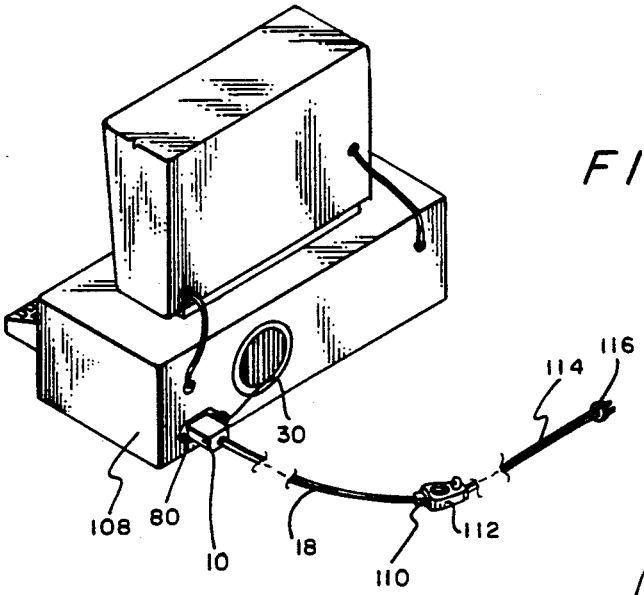
FIG. 16
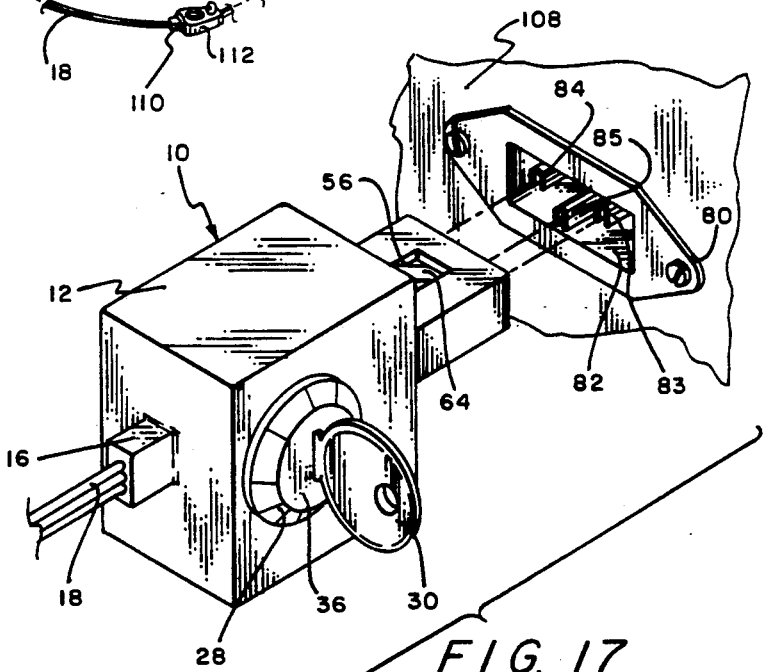
FIG. 17
FIG. 18
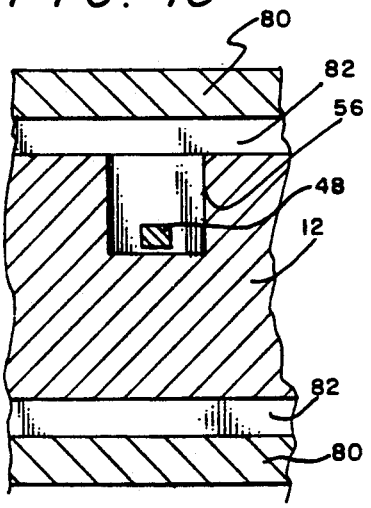
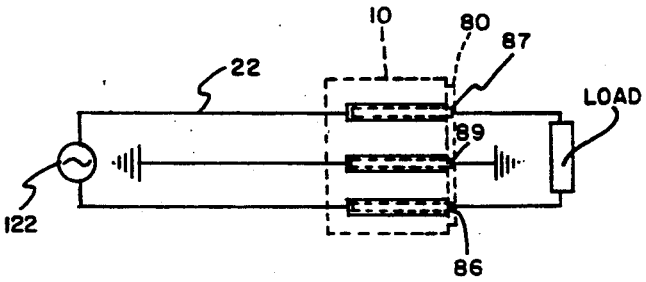
FIG. 19

LOCKING CONNECTOR FOR DETACHABLE POWER CORDS

BACKGROUND OF THE INVENTION

This invention relates to connectors for attaching detachable electrical power cords to electrically powered equipment, especially to personal computers and desk-top laser printers, specifically to an improved connector that locks in place and can be detached from an electrically powered apparatus only by an authorized person. The advantage of the present invention will be realized when same is used in conjunction with other apparatus intended to prevent the use of electrically powered equipment by unauthorized users. Such other apparatus could, for instance, consist of a controlled-access means for simultaneously retaining the electrical plug of the power cord, which is connected to the invention, in a socket in said apparatus while selectively enabling and disabling the flow of electrical current thereto as desired by an authorized user. Alternatively, the power cord to which the present invention (a connector) is attached could incorporate a key-controlled means for selectively enabling and disabling the flow of electrical current through said power cord as desired by an authorized user. Thus, it will be seen that the present invention is simply a power-cord connector that can not be removed from an appliance by an unauthorized person, and that the advantage thereof will be realized only when the power cord attached to the subject connector is provided with an effective, access-controlled means for enabling and preventing the the flow of electrical current through said power cord and connector as desired by an authorized user.

Various devices have been proposed and implemented for preventing the unauthorized use of electrically powered equipment by preventing the flow of electric current through the appliance power cord. Some of these devices are lockouts that enclose the conventional power plug of the appliance cord in such a fashion that the plug can not be engaged in an electrical wall outlet. Other of these devices lock the conventional appliance cord plug into the device, provide a means for supplying electrical power to the device, and further provide a means (usually a key-controlled switch) for permitting or preventing the flow of electricity from the device to the appliance power cord. Still other of these devices utilize a specially designed cord plug that looks into a mating specially designed power outlet to control the availability of electrical current to the power cord.

The number of embodiments proposed and implemented of such locking devices suggests a wide-spread desire to control operative access to various electrically powered appliances and apparatus. The reasons given for wanting to control such operative access are numerous. Among them are: to protect children and other individuals who do not possess sufficient knowledge or understanding of the operation of certain types of electrically powered equipment to operate same safely; to protect delicate electronic equipment from damage by untrained operators; to prevent economic waste of electricity and supplies (as for copy machines, fax machines, and laser printers), and to prevent unnecessary equipment wear; to control the viewing of television and video-tape programming by children; and to preserve the confidentiality of computer files.

Heretofore, however, locking devices such as those recited above were rendered ineffective (sometimes at the complete oblivion of the equipment owner) in the case of an appliance or apparatus equipped with a detachable power cord (such as are most personal computers and desk-top laser printers, for example). In such an installation, an unauthorized user could simply disengage the appliance cord from the appliance or apparatus, engage thereunto an alien, unencumbered power cord, engage the power plug of the alien appliance cord into an electrical wall outlet, and use the appliance or apparatus at will.

Many users of electrically powered apparatus that is equipped with detachable power cords would therefore find it desirable to have a power cord which they could readily engage and disengage from the apparatus, but which an unauthorized person could not disengage. Upon obtaining such a cord, the user could then avail himself of, and effectively use, any desired lockout or other device for controlling the flow of electrical current through the power cord to the user's electrically powered apparatus.

OBJECTS AND ADVANTAGES

Accordingly. several objects and advantages of my invention are: to provide the missing element (namely, the connector of this invention) required for the production of controllably detachable appliance power cords and cordsets to provide such cords and cordsets which may readily be used with existing appliance power connecting sockets without the need to alter or replace such sockets, to provide such cords and cordsets which require a minimum of skill and effort to use, and to provide such cords and cordsets which may be effectively used in conjunction with existing lockouts and devices designed to prevent the use of electrically powered appliances and apparatus by unauthorized persons.

In addition, I claim the following additional objects and advantages of my invention: to provide a missing element (namely, the connector of this invention) required for the production of controllably detachable appliance power cords and cordsets that are further distinguished by the imposition of a controlled (as with a key-operated or combination lock) switch in-line between the electrical-input end (which may be wired directly to an electrical power source or wired into an electrical circuit, or may be equipped with a power plug designed to be engaged in an electrical wall outlet, for instance) and the appliance-connecting end of such cords and cordsets, so that the resulting cords and cordsets provide complete protection against the unauthorized use of the electrical appliances and apparatus to which they are engaged, thus overcoming any need for additionally purchasing power lockouts or other devices designed to prevent the unauthorized use of electrically powered equipment.

Further objects and advantages of the invention will become apparent from a consideration of the accompanying drawings and the ensuing description.

DESCRIPTION OF DRAWINGS

FIG. 1 is a front perspective elevation view of a connector according to the invention.

FIG. 2 shows a side elevation view of such connector engaged and locked in a mating standard appliance power socket.

FIG. 3 shows a back view of such connector.

FIG. 4 is a top elevation view of such connector.

FIG. 9 shows a side view of the eccentric cam and unlocking rod of the connector of FIG. 3 as taken along the direction of line 9—9, shown in the locked position, with the unlocked cam position superimposed in phantom.

FIG. 10 is a front view of the eccentric cam attached to the lock assembly in such connector.

FIG. 11 is a fragmentary sectional side view of such connector shown engaged and locked in a mating standard appliance power socket.

FIG. 12 is a fragmentary sectional back view of the front portion of the connector and appliance power socket of FIG. 11 taken along the direction of line 12—12, showing the obstructing element of such connector.

FIG. 13 is a perspective bottom view of a sharp, chisel-pointed obstructing element and associated fulcrum of such connector.

FIG. 14 is a perspective bottom view of an alternate, serrated-tip embodiment of the obstructing element of such connector.

FIG. 15 is a perspective bottom view of an alternate, rubbery-tipped embodiment of the obstructing element of such connector.

FIG. 16 is a perspective relational elevation view of such connector and operatively associated equipment. The connector of the invention is shown engaged in the appliance power socket of a protected appliance. The power cord attached to the connector is shown engaged in a locking power-control device, and the power cord and plug of the latter are also shown.

FIG. 17 is a perspective back elevation view of such connector and mating standard appliance power socket.

FIG. 18 is a fragmentary cross-sectional front view of a portion of the housing of such connector, shown engaged in a mating standard appliance power socket, as taken along the direction of line 18—18 of FIG. 11.

FIG. 19 is an electrical schematic diagram of such connector and operatively associated power source, power cord, appliance power socket, and appliance internal electrical circuitry.

DRAWING REFERENCE NUMERALS

Figure 5:
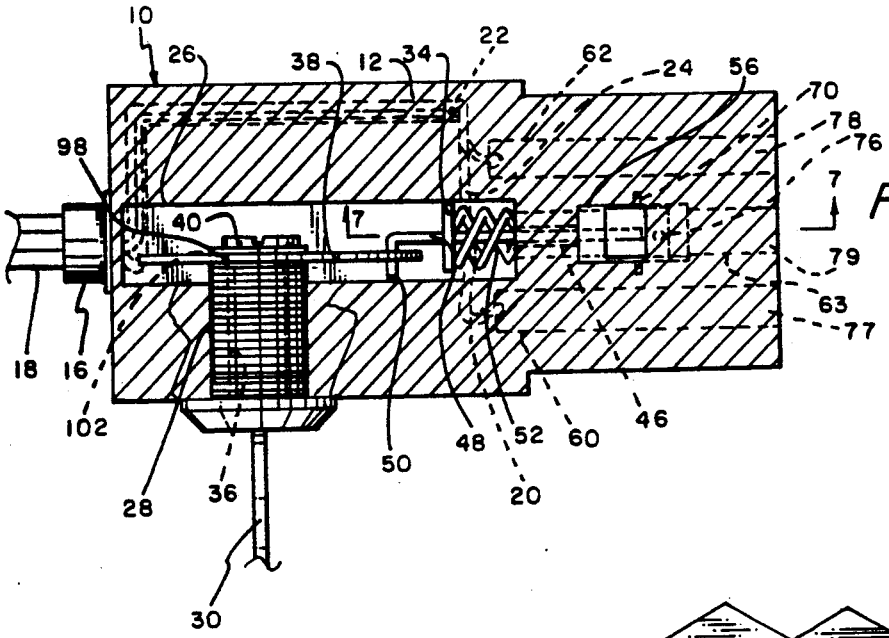
FIG. 5 is a top sectional view showing the connector of FIG. 2 as taken along the direction of angular line 5—5, with a second section being taken at the area of the lock assembly.
Figure 6:
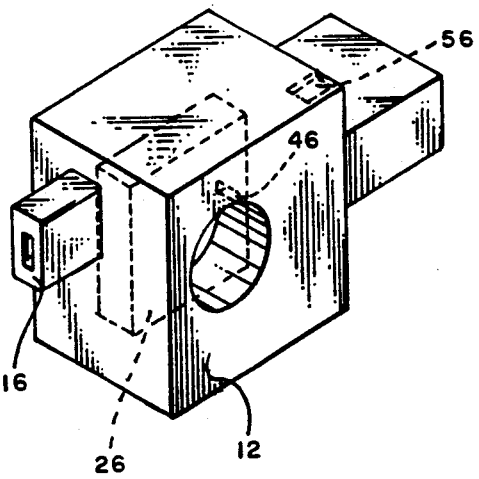
FIG. 6 is a back perspective view of the housing for such connector.
Figure 7:
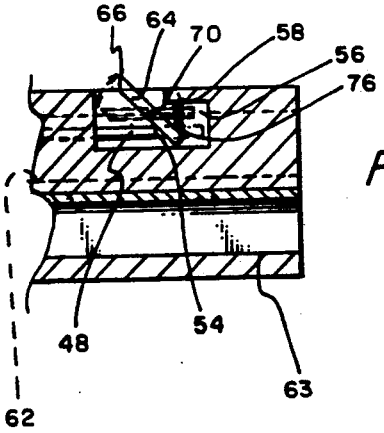
FIG. 7 is a fragmentary partial side sectional view of the connector of FIG. 5 showing the obstructing element assembly as taken along the direction of line 7—7.
Figure 8:
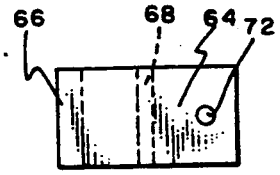
FIG. 8 is a top view of the obstructing element of a connector according to the invention.

10 connector
12 housing of 10
14 face of 12
16 strain relief
18 power cord
20 first conductor
22 second conductor
24 grounding conductor
26 cavity in 12 for 38
28 lock assembly
30 key for 28
32 square hole in 38
34 flange on 48
36 rotating key plug
38 eccentric cam
40 machine screw
42 unlocked detent of 38
44 locked detent of 38
46 channel in 12 for 48
48 unlocking rod
50 elbow of 48
52 compression spring for 48 & 50
54 end of 48
56 chamber in 12
58 overhang of 56
60 electrical contact of 20
62 electrical contact of 22
63 grounding contact of 24
64 obstructing element
66 sharpened tip of 64
68 transverse cylindrical void in 64
70 fulcrum for 64, 88, or 106
72 cylindrical recess in 64
74 cylindrical recess in 58
76 compression spring for 64, 88, or 106
77 first terminal cavity in 12
78 second terminal cavity in 12
79 ground terminal cavity in 12
80 appliance power socket
82 recess in 80
83 first terminal of 80
84 second terminal of 80
85 ground terminal of 80
86 first terminal lug of 80
87 second terminal lug of 80
88 obstructing element
89 ground terminal lug of 80
90 rubbery mass affixed to tip of 88
92 transverse cylindrical void in 88
94 cylindrical recess in 88
98 lock washer
102 square shaft of 36
104 sharp, serrated tip of 106
106 obstructing element
108 protected appliance
110 electrical plug for 18
112 locking power-control device
114 power cord for 112
116 electrical plug for 114
118 cylindrical recess in 106
120 transverse cylindrical void in 106
122 electricity source

DESCRIPTION OF THE INVENTION

FIG. 1 shows a controllably detachable connector 10 for connecting an electrical appliance cord 18 to a mating appliance power socket 80 according to the best embodiment presently contemplated for carrying out the invention.

The location of connector 10 in relation to other operatively associated apparatus which is not part of the present invention is shown in FIG. 16. Connector 10 engages appliance power socket 80 of protected appliance 108. Power cord 18 is connected to connector 10 on one end, and terminates in a conventional electrical plug 110 on the opposing end. Electrical plug 110 is locked into a power socket in locking power-control device 112, which is connected to power cord 114, which in turn terminates in electrical plug 116.

Housing 12 is constructed of slightly resilient molded plastic of any variety that is commonly used for molded connectors found on cordsets. Power cord 18 confines insulated conductors 20 and 22, and insulated grounding conductor 24. Power cord 18 is permanently affixed to housing 12 by way of strain relief 16. As shown in FIG. 19, electricity source 122 is connected to conductors 20 and 22. Best seen in FIG. 5, conductor 20 is electrically connected to contact 60, which is disposed in cavity 77. Conductor 22 is electrically connected to contact 62, which is disposed in cavity 78. In similar fashion, grounding conductor 24 is electrically connected to grounding contact 63 disposed in cavity 79.

Key 30 is a controlled-access operating means for selectively locking connector 10 into and releasing same from appliance power socket 80. Key 30 engages lock assembly 28, best seen in FIG. 5. Lock assembly 28 is imbedded in the molded plastic of housing 12. Rotating key plug 36 is the portion of lock assembly 28 that can be rotated whenever key 30 is engaged. The inboard end of rotating key plug 36 terminates in a shaft 102 approximately 8 mm square by 3 mm long. Centered in the end thereof is a threaded mating hole for machine screw 40 Eccentric cam 38 is attached, by means of square hole 32, to shaft 102 with lock washer 98 and machine screw 40. Eccentric cam 38 and the inboard end of lock assembly 28 are disposed in cavity 26 of housing 12.

Best seen in FIG. 11, chamber 56 is a generally "L"-shaped void in connector 10 opposite cavity 79. It is essentially centered laterally within housing 12, and is about 6 mm wide. The bottom extent of the chamber is about 5 mm below the surface of housing 12. At the surface of housing 12, chamber 56 extends from about 7 mm to about 12 mm distant from face 14 At its longest extent, chamber 56 extends from about 4 mm to about 12 mm distant from face 14. At its end nearest face 14, chamber 56 is about 3 mm in vertical dimension, undercutting overhang 58 which is about 2 mm in thickness.

Obstructing element 64 is a metal blade about 5 mm wide by 11 mm long by 2 mm thick. It has an oblique cylindrical recess 72 about 1 mm deep aligned with spring 76 in the top surface of the end nearest face 14. Said element has a transverse cylindrical void 68 near its center. Said element terminates in a sharpened tip 66 which is flat on the top surface and bevelled sharply on the opposing surface, forming a cutting edge quite similar in scope to those found on common woodworking chisels. Obstructing element 64 is pivotally mounted in chamber 56 about fulcrum 70. Fulcrum 70 is a metal pin which extends through transverse cylindrical void 68, and whose ends are disposed in the plastic of housing 12. Spring 76 is a compression spring situated between cylindrical recess 72 of obstructing element 64, and cylindrical recess 74 of overhang 58.

Channel 46 is a rectangular passageway between cavity 26 and chamber 56. Unlocking rod 48 is a rectangular metal rod that extends from cavity 26 into chamber 56 via channel 46. Flange 34 is a flat metal plate encircling unlocking rod 48 and affixed thereto. Channel 46 is only slightly larger in breadth and depth than is unlocking rod 48. Elbow 50 begins as a generally right-angle bend in 48 about its vertical axis near the end that originates inside cavity 26, and terminates in a short leg that is generally rounded on the side that contacts eccentric cam 38. It is so-constructed that it intersects the path of cam 38 at an angle of approximately 90 degrees. End 54 of unlocking rod 48 is disposed in chamber 56 and contacts obstructing element 64 at a point nearer to face 14 than is transverse cylindrical Void 68. Spring 52 is a compression spring circumscribing unlocking rod 48. It is freely positioned between flange 34 on unlocking rod 48 and the front wall of cavity 26.

Appliance power socket 80 is a conventional appliance power connecting socket that is not part of the present invention, but is mechanically attached and electrically connected to an electrical appliance or device (especially a desk-top computer). First terminal 83 thereof is an elongated electrical connecting means disposed in recess 82 and firmly mounted in appliance power socket 80. It is electrically connected to first terminal lug 86, which is electrically connected to the internal power supply circuitry of the electrical appliance or device to be protected. Second terminal 84 thereof is an elongated electrical connecting means disposed in recess 82 and firmly mounted in appliance power socket 80. It is electrically connected to second terminal lug 87, which is electrically connected to the internal power supply circuitry of the electrical appliance or device to be protected. Ground terminal 85 thereof is an elongated electrical connecting means disposed in recess 82 and firmly mounted in appliance power socket 80. It is electrically connected to ground terminal lug 89, which is electrically connected to the grounding circuitry of the electrical appliance or device to be protected.

OPERATION

In order to connect an appliance power cord to an electrical appliance or device using the controllably detachable power cord connecting device of FIGS. 1–6, 16, and 17, the user should simply align terminal cavities 77, 78, and 79 of connector 10 with terminals 83, 84, and 85, respectively, of socket 80 mounted on the appliance or device to be protected, then push connector 10 into recess 82 of socket 80 as far as possible. Key plug 36 will normally be in its counterclockwise UNLOCKED position at this time, but even if it is in its clockwise LOCKED position, Key 30 will not be needed for this operation, since obstructing element 64 will be forced, upon encounter with the rigid structure of socket 80, to pivot about fulcrum 70 (compressing spring 76 in chamber 56) as far as is necessary to permit engagement of connector 10 into recess 82 of socket 80. As shown in FIG. 16, conventional electrical plug 110 on the end of the appliance power cord 18 opposite connector 10 of the invention should then be engaged in the electrical outlet of a locking power-control device (112) which, in turn, is connected to an electrical power source or supply circuit (122 of FIG. 19) by means of power cord 114 and electrical plug 116. If power cord 18 is constructed with an access-control means (such as a key-operated switch) in-line between connector 10 and conventional electrical plug 110 on the opposing cord end, then electrical plug 110 may be engaged directly in a conventional electrical wall outlet. These actions will result in:

(a) creation of a potential path for electrical current to flow from the electrical power source or supply circuit (122), through the access-control means (112), through first conductor 20 of power cord 18, through electrical contact 60, into first terminal 83 of appliance power socket 80, through first terminal lug 86, through the electrical load (shown in FIG. 19) of the appliance or device to be protected (108), and to return to the electrical power source or supply circuit via second terminal lug 87, second terminal 84, electrical contact 62, and second conductor 22;

(b) creation of a potential path for any anomalous electrical energy which may be present in the appliance or device to be protected, to flow from any grounding circuitry present in the appliance or device to ground terminal lug 89, through ground terminal 85, into grounding contact 63, disposed in ground terminal cavity 79 of housing 12, through grounding conductor 24, through the grounding prong of the conventional electrical plug 110 on the distant end of power cord 18, into the grounding contacts of the controlled-access power outlet or conventional wall-outlet socket, thence to ground via any existing grounding circuitry electrically connected to the ground contacts of the outlet;

Once connector 10 has been engaged in socket 80 as described above, key 30 should be engaged in lock assembly 28 and rotated clockwise until rotating key plug 36 is in its LOCKED position (unless rotating key plug 36 was already in the clockwise LOCKED position when connector 10 was engaged in socket which will result in the following:

(a) eccentric cam 38, being attached to shaft 102 by means of square hole 32 with lock washer 98 and machine screw 40, will rotate clockwise through an arc of approximately 90 degrees, at which time locked detent 44 is engaged by elbow 50 of unlocking rod 48;

(b) energy stored in compression spring 52 will press against flange 34 of 48, and thus will keep elbow 50 in contact with eccentric cam 38, and cause end 54 of unlocking rod 48 to move away from face 14 of housing 12;

(c) energy stored in compression spring 76 will cause obstructing element 64 to pivot about fulcrum 70, causing sharpened tip 66 to return to its locking position, extended beyond the body of housing 12 through the opening of chamber 56 in housing 12;

(d) connector 10 will be held engaged in appliance power socket 80 by means of sharpened tip 66 of obstructing element 64 digging into the plastic housing of appliance power socket 80, whereby disengagement of connector 10 is prevented; and (e) when used in conjunction with the hereinabove-specified access-control means operatively associated with power cord 18, consummate control over the availability of electrical current to the appliance or device to be protected will by realized, since power cord 18 is mechanically and electrically connected to connector 10, which Will now be locked and engaged in appliance power socket 80 so as to circumvent surreptitious engagement of an alien, unencumbered appliance power cord therein.

Any person authorized to disengage connector 10 from appliance power socket 80 should be provided with an original or a copy of key 30 for lock assembly 28. When key 30 is engaged in lock assembly 28 and rotated counterclockwise to the UNLOCKED position, the following will result:

(a) eccentric cam 38, being attached to shaft 102 by means of square hole 32 with lock washer 98 and machine screw 40, will rotate counterclockwise through an arc of approximately 90 degrees, at which time unlocked detent 42 is engaged by elbow 50 of unlocking rod 48;

(b) energy stored in compression spring 52 will press against flange 34 of 48 and thus will keep elbow 50 in contact with eccentric cam 38;

(c) rotation of eccentric cam 38 will push unlocking rod 48 through channel 46 toward face 14 of housing 12;

(d) compression spring 52 will be squeezed between flange 34 and the front wall of cavity 26 in housing 12;

(e) end 54 of unlocking rod 48 will press against obstructing element 64 at a point between transverse cylindrical void 68 and face 14, causing obstructing element 64 to pivot about fulcrum 70;

(f) compression spring 76 will be compressed;

(g) sharpened tip 66 of obstructing element 64 will be retracted away from the plastic housing of appliance power socket 80 and into chamber 56 of housing 12;

(h) connector 10 may be disengaged from appliance power socket 80.

SERRATED-TIP OBSTRUCTING ELEMENT CONNECTOR

FIG. 14 shows a serrated-tip obstructing element 106 for the connector according to another embodiment of the invention. When the present invention incorporates obstructing element 106 of FIG. 14, in place of obstructing element 64 of FIG. 13, use, operation, and effect of the connector of the invention are exactly the same as specified in the preceding paragraphs.

The serrated-tip obstructing element 106 is distinguished from the chisel-pointed, sharpened-blade obstructing element 64 of FIG. 13 only in that the former includes multiple sharpened teeth (104) at the obstructing end, whereas the latter includes sharpened, chisel-pointed tip 66 at the obstructing end. When unlocking rod 48 is in its locking position, compression spring 76, being disposed between cylindrical recess 74 in overhang 58, and oblique, cylindrical recess 118 in obstructing element 106, will cause obstructing element 106 to pivot about fulcrum 70, which extends through transverse cylindrical void 120 in obstructing element 106, whereby serrated tip 104 will be held in contact with the housing of appliance power socket 80. When force is exerted by an unauthorized user in an effort to disengage connector 10 from appliance power socket 80, the sharp teeth of serrated tip 104 will dig into the plastic housing of appliance power socket 80, preventing disengagement of the connector.

Users will find use of the serrated-tip obstructing element connector advantageous when an appliance power socket 80 constructed of relatively hard plastic is encountered, since the several sharp teeth (104) of obstructing element 106 will dig into hard plastic with greater ease than will the chisel-pointed tip of obstructing element 64.

RUBBERY-TIPPED OBSTRUCTING ELEMENT CONNECTOR

FIG. 15 shows a rubbery-tipped obstructing element 88 for the connector according to another embodiment of the invention. When the present invention incorporates obstructing element 88 of FIG. 14, in place of obstructing element 64 of FIG. 13, use, operation, and effect of the invention are exactly the same as specified in the preceding paragraphs.

The rubbery-tipped obstructing element 88 is distinguished from the chisel-pointed, sharpened-blade obstructing element 64 of FIG. 13 only in that the former includes a mass of resilient, friction-producing material (90) affixed to a blunt, obstructing end, whereas the latter includes sharpened tip 66 at the obstructing end. When unlocking rod 48 is in its locking position, compression spring 76, being disposed between cylindrical recess 74 in overhang 58, and oblique, cylindrical recess 94 in obstructing element 88, will cause obstructing element 88 to pivot about fulcrum 70, which extends through transverse cylindrical void 92 in obstructing element 88, whereby rubbery tip 90 will be held in contact with the rigid housing of appliance power socket 80. When force is exerted by an unauthorized user in an effort to disengage connector 10 from appliance power socket 80, rubbery tip 90 will be wedged tightly into the space between obstructing element 88 and appliance power socket 80, preventing disengagement of the connector.

Users will find use of the rubbery-tipped obstructing element connector advantageous since it will not mar the inner surface of recess 82 in appliance power socket 80.

Thus, the reader will see that the connector of the invention provides the only remaining element needed but currently unavailable for the production of controllably detachable power cords and cordsets that can, when operatively associated with an effective, controlled-access means for selectively enabling and preventing the flow of electrical current through such power cords or cordsets, provide complete control over the availability of electrical power to electrical appliances and equipment that use detachable power cords or cordsets, yet requires no modification to existing electrical appliances, devices, or apparatus, and requires no tools or special skills for attaching to same electrical power cords or cordsets equipped with the connector of the invention.

While the above description contains many specificities, these should not be construed as limitations on the scope of the invention, but rather as exemplifications of preferred embodiments thereof. Those skilled in the art will envision many other possible variations that are within its scope. For example, skilled artisans will readily be able to change the dimensions and shapes of many of the components recited. They can mount the elements, described and illustrated as being located within chamber 56, within a rigid framework (as of metal or plastic, for instance), then insert the framework assembly into a generally rectangular chamber located at the approximate position of chamber 56 in the drawings. They can replace machine screw 40 with: a rivet; a nut and mating threads; or a welded joint., or they can produce rotating key plug 36 and eccentric cam 38 as a single piece of material. They can change the direction and angle of rotation required for key 30 to lock and unlock connector 10 by simply changing the shape of eccentric cam 38. They can replace the key lock with a combination lock and a tab, knob, or the like. They can replace compression spring 76 with mechanical linkage to hold the tip of the obstructing element (64, 88, or 106) in contact with socket 80. Accordingly, the reader is requested to determine the scope of the invention by the appended claims and their legal equivalents, and not by the examples which have been given.

I claim:

1. A connecting device for an electrical power cord that is controllably detachable from a mating standard appliance power socket which is operatively associated with an electrically powered appliance or apparatus, said device comprising a housing bearing at least one electrical contact and associated circuitry means to facilitate continuity of electrical current flow between at least one conductor in a power cord attached to said housing and a conductor in said mating appliance power socket, wherein the improvement comprises:

an obstructing means mounted in said housing by way of a mounting means to facilitate the extension of a portion of said obstructing means, through an opening, beyond the body of said housing and into contact with said appliance power socket, whereby disengagement of said connecting device from said socket is prevented; and a controlled-access operating means to facilitate retracting said obstructing means into a position essentially within the bounds of said housing, whereby said connecting device may be freely disengaged from said socket.

2. The connecting device of claim 1 wherein said obstructing means comprises a rigid, beveled blade.

3. The connecting device of claim 1 wherein said obstructing means comprises a rigid blade with serrated tip.

4. The connecting device of claim 1 wherein said obstructing means includes a mass of resilient, friction-producing material affixed thereto.

5. The connecting device of claim 1 wherein said obstructing means is held in contact with said appliance power socket by spring tension.

6. The connecting device of claim 1 wherein said controlled-access operating means for retracting said obstructing means includes a key.

* * * * *